United States Patent [19]

Ichida et al.

[11] Patent Number: 4,553,473

[45] Date of Patent: Nov. 19, 1985

[54] VALVE ACTUATING MECHANISM FOR ENGINES

[75] Inventors: Katsumi Ichida, Tokyo; Koichi Fukuo, Saitama; Junichi Araki, Saitama; Isao Machida, Saitama, all of Japan

[73] Assignee: Honda Giken Kogyo Kabushiki Kaisha, Tokyo, Japan

[21] Appl. No.: 539,044

[22] Filed: Oct. 4, 1983

[30] Foreign Application Priority Data

Oct. 20, 1982 [JP] Japan ..... 57-183840

[51] Int. Cl.[4] ..... F01B 1/04

[52] U.S. Cl. ..... 92/261; 92/149; 474/261; 123/90.27; 123/90.31; 123/193 H

[58] Field of Search ..... 92/137, 149, 261; 474/88, 84; 123/DIG. 6, DIG. 7, 195 A, 90.31, 90.27, 193 H

[56] References Cited

U.S. PATENT DOCUMENTS

| | | | |
|---|---|---|---|
| Re. 24,262 | 12/1956 | Turlay | 123/DIG. 7 |
| 2,041,979 | 5/1936 | Thege | 92/149 |
| 3,422,806 | 1/1969 | DeLorean | 123/90.31 |
| 3,738,338 | 6/1973 | Wickman | 123/90.27 |
| 4,230,074 | 10/1980 | Ichikawa et al. | 123/90.27 |

FOREIGN PATENT DOCUMENTS

| | | | |
|---|---|---|---|
| 603052 | 6/1948 | United Kingdom | 123/90.31 |
| 700040 | 11/1953 | United Kingdom | 92/149 |

*Primary Examiner*—Paul E. Maslousky
*Attorney, Agent, or Firm*—Lyon & Lyon

[57] ABSTRACT

A DOHC engine of the V-type has two cylinder heads each detachably secured to a cylinder block. A crank shaft on the block drives two intermediate shafts, one on each cylinder head, by means of an endless flexible element. An additional flexible endless element is provided in each cylinder head to drive two cam shafts from the intermediate shaft on that cylinder head. Each endless flexible element together with its toothed pulleys or sprockets and its timing belt or chain is described as a wrap-around transmission.

3 Claims, 3 Drawing Figures

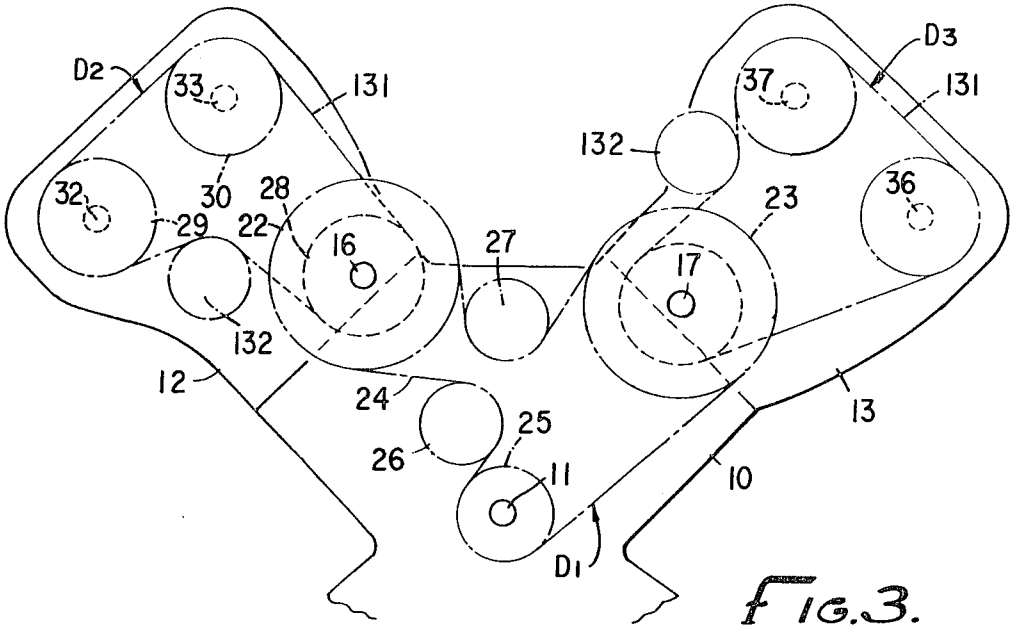
FIG. 3.
FIG. 2.
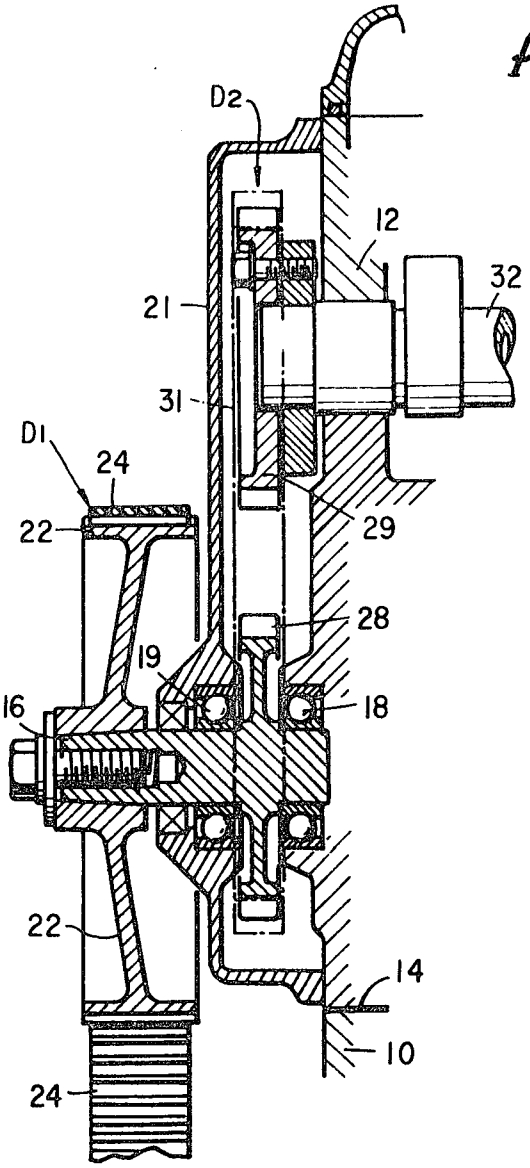

VALVE ACTUATING MECHANISM FOR ENGINES

This invention relates to a valve actuating mechanism for a double overhead cam shaft engine, known in the art as a DOHC type engine. The engine crank shaft is borne in a cylinder block, but a pair of intake and exhaust valve actuating cam shafts are borne in a cylinder head. The cylinder head and the cylinder block are detachably connected so that maintenance work can be performed when necessary. The first "wrap-around transmission" characterized by an endless belt or chain turns laterally spaced intermediate shafts each carried on cylinder heads positioned in the shape of the letter "V". A second wrap-around transmission comprises an endless chain or timing belt driving the two cam shafts on one cylinder head in timed relationship. A third wrap-around transmission of the same type as the second drives the other two cam shafts from the intermediate shaft on the other cylinder head.

There is known in the prior art a mechanism in which an intermediate shaft is borne in the cylinder block, not the cylinder head, and has one end connected to the crank shaft through a first wrap-around transmission and its other end connected to said paired cam shafts through a second wrap-around transmission. In this form of valve actuating mechanism, the second wrap-around transmission must be disassembled when it is necessary to perform maintenance on the engine requiring separation of the cylinder head and the cylinder block. Since the second wrap-around transmission includes three shafts, the intermediate shaft and the two valve actuating cam shafts, these three shafts have to be adjusted into phase when they are to be reassembled, so that no error occurs in the timing of the opening and the closing of the intake and exhaust valves of the engine. The phase adjustment of those three shafts is so troublesome as to cause deterioration in the working efficiency upon reassembly.

The present invention has for its principal object the provision of an effective valve actuating mechanism in which an intermediate shaft is borne on each cylinder head (not the cylinder block). The intermediate shaft has one end connected to the crank shaft through the first wrap-around transmission and is connected to the paired cam shafts through a second wrap-around transmission. In case it is necessary to separate the cylinder block and the cylinder head, the timing relationship between the intermediate shaft and the paired crank shafts is not disturbed.

Other and more detailed objects and advantages will appear hereinafter.

In the drawings:

FIG. 2 is a sectional view taken substantially on the lines II—II as shown on FIG. 1.

FIG. 3 is a view similar to FIG. 1 showing a modification, in diagrammatic form.

Figure 1:
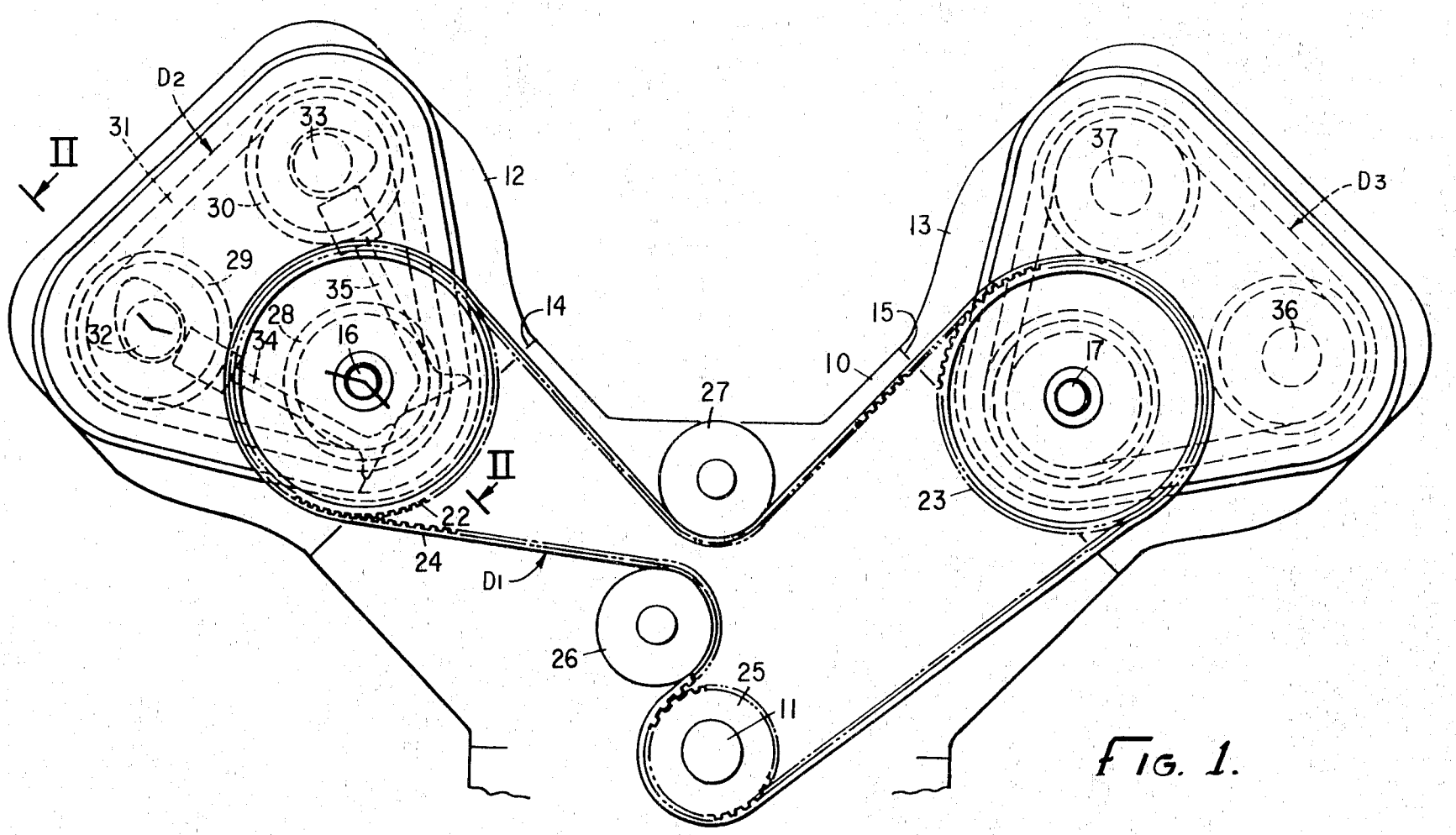
FIG. 1 is a side elevation showing a preferred embodiment of this invention.

Referring to the drawings, the V-shaped cylinder block 10 is formed as one integral unit in which the crank shaft 11 is positioned. The engine is of the DOHC type in which each cylinder head 12 and 13 is detachably secured to the cylinder block 10 at a joint 14,15. On each of the cylinder heads 12 and 13 there is mounted an intermediate shaft 16,17 carried in spaced bearings 18 and 19 supported on the cylinder head 12 and head cover 21. On each of the intermediate shafts 16 and 17 there is secured an intermediate toothed pulley 22,23. A timing belt 24 connects the toothed pulley 25 on the crank shaft 11 to each of the intermediate pulleys 22 and 23 so that they all rotate in timed relationship. The timing belt 24 and the toothed intermediate pulleys 22 and 23 are referred to hereinafter as the first wrap-around transmission. Pulleys 26 and 27 are mounted on the cylinder block 10 and each contacts the back side of the timing belt 24 to maintain the desired tension in the belt.

The construction and operation of the parts contained within each cylinder head 12,13 are substantially the same and therefore a detailed description of only one is required. Considering the cylinder head 12, a second wrap-around transmission $D_2$ is formed by the aligned sprockets 28, 29 and 30 connected by the endless chain 31. The sprocket 29 is fixed on the cam shaft 32 and the sprocket 30 is fixed on the cam shaft 33. The cam shaft 32 operates exhaust valve 34 and cam shaft 33 operates intake valve 35.

From this description it will be understood that the first wrap-around transmission $D_1$ drives the intermediate shafts 16 and 17 from the crank shaft 11. A second wrap-around transmission $D_2$ drives the cam shafts 32 and 33 from the intermediate shaft 16. A third wrap-around transmission $D_3$ drives the cam shafts 36 and 37 from the intermediate shaft 17.

In the construction thus far described, when the crank shaft 11 rotates, it drives through the first wrap-around transmission $D_1$ to rotate the intermediate shafts 16 and 17. Since the driven pulleys 22 and 23 each have twice the number of teeth as the driving pulley 25, the intermediate shafts 16 and 17 turn at one-half the speed of the crank shaft 11. The driving sprocket 28 has the same number of teeth as the driven sprockets 29 and 30 so that the cam shafts 32 and 33 are both driven at the same speed as the intermediate sprocket 28.

When it is desired to separate one of the cylinder heads 12,13 from the cylinder block 10 for maintenance purposes, it is only necessary to remove the timing belt 24 from the driven pulley on the cylinder heads which is to be detached. The wrap-around transmission on that cylinder head need not be disturbed. After the maintenance work has been completed, the cylinder head is reinstalled on the cylinder block 10. The driven pulley 22,23 from which the timing belt 24 has been removed is then adjusted to a predetermined rotational phase with respect to the crank shaft 11, and the timing belt 24 is then wrapped around the driven pulley.

The modified form of the invention shown in FIG. 3 is similar to the preferred embodiment described above except that roller-type timing chains 131 are employed, and an additional chain tensioning sprocket 132 is provided on each of the cylinder heads. Parts similar to those described in connection with FIGS. 1 and 2 are designated by the same reference characters.

Certain other modifications of this invention are contemplated. For example, the timing belts 24 could be replaced by an endless chain, and the endless chains of the cylinder heads could be replaced by timing belts.

As compared with conventional constructions in which each intermediate shaft must be retimed in relation to its respective cam shafts following disassembly and replacement of the cylinder head, the working efficiency of the device of the present invention is remarkably improved. This is because the wrap-around transmission between the intermediate shaft and the two cam shafts need not be disturbed.

In either form of the invention, as described above, the pulley or sprocket largest in diameter is located on the intermediate shaft in the intermediate portion of the cylinder head so that the size of the cylinder head can be reduced.

Having fully described our invention, it is to be understood that we are not to be limited to the details herein set forth but that our invention is of the full scope of the appended claims.

We claim:

1. In a DOHC engine of the V-type, the combination of: a cylinder block having a crank shaft, two cylinder heads on said cylinder block to form a V-shape relationship, each cylinder head having two cam shafts and an intermediate shaft mounted thereon, a first wrap-around transmission connecting said crank shaft to both of said intermediate shafts, a second wrap-around transmission connecting one of said intermediate shafts to the two cam shafts on the same cylinder head with that intermediate shaft, and a third wrap-around transmission connecting the other of said intermediate shafts to the two cam shafts on the same cylinder head with said other intermediate shaft, whereby either of the cylinder heads may be removed from said cylinder block upon disassembly of the first wrap-around transmission and without disturbing the said second or third wrap-around transmissions.

2. The combination set forth in claim 1 in which each wrap-around transmission includes an endless belt or chain.

3. In a DOHC engine of the V-type, the combination of: a cylinder block having a crank shaft, two cylinder heads on said cylinder block to form a V-shape relationship, each cylinder head having two cam shafts and an intermediate shaft mounted thereon, means including a first endless flexible element for driving both of said intermediate shafts from said crank shaft, means including a second endless flexible element connecting one of the intermediate shafts to the two cam shafts on the same cylinder head with that intermediate shaft, and means including a third endless flexible element connecting the other of said intermediate shafts to the two cam shafts on the same cylinder head with said intermediate shaft, whereby either of the cylinder heads may be removed from said cylinder block upon disassembly of the first endless flexible element and without disturbing said second or third endless flexible elements.

* * * * *